US007562865B2

(12) United States Patent
Penning

(10) Patent No.: US 7,562,865 B2
(45) Date of Patent: Jul. 21, 2009

(54) MULTI-PURPOSE PORTABLE LAY-DOWN POST AND FENCING SYSTEM

(75) Inventor: Dennis E. Penning, St. Louis, MO (US)

(73) Assignee: Flexmedia Partnership, LLC, St. Louis, MO (US)

( * ) Notice: Subject to any disclaimer, the term of this patent is extended or adjusted under 35 U.S.C. 154(b) by 87 days.

(21) Appl. No.: 11/052,379

(22) Filed: Feb. 7, 2005

(65) Prior Publication Data

US 2005/0173690 A1 Aug. 11, 2005

Related U.S. Application Data

(63) Continuation-in-part of application No. 10/629,980, filed on Jul. 30, 2003, now Pat. No. 6,851,661.

(51) Int. Cl.
*E04H 17/00* (2006.01)

(52) U.S. Cl. ..... 256/65.14

(58) Field of Classification Search ..... 256/1, 256/45, 65.14; 404/10; 248/156, 538
See application file for complete search history.

(56) References Cited

U.S. PATENT DOCUMENTS

| | | | | |
|---|---|---|---|---|
| 1,857,435 | A | 5/1932 | Cole | |
| 1,877,074 | A | 9/1932 | Stanziale | |
| 2,148,117 | A * | 2/1939 | Gettig | 134/134 |
| 2,148,177 | A * | 2/1939 | Sherman | 267/254 |
| 2,949,324 | A | 8/1960 | Birge et al. | |
| 3,067,717 | A * | 12/1962 | Imparato | 248/156 |
| 3,250,517 | A * | 5/1966 | Bramley | 256/10 |
| 4,106,879 | A | 8/1978 | Diedershagen et al. | |
| 4,240,766 | A | 12/1980 | Smith et al. | |
| 4,565,025 | A * | 1/1986 | Behrle | 248/538 |
| 4,605,204 | A | 8/1986 | Schmanski et al. | |
| 4,787,603 | A | 11/1988 | Norton | |
| 4,806,046 | A | 2/1989 | Clark | |
| 4,940,018 | A * | 7/1990 | Edling | 119/708 |
| 5,066,163 | A | 11/1991 | Whitaker | |
| 5,180,143 | A | 1/1993 | Brower | |
| 5,186,119 | A | 2/1993 | Hlavin | |
| 5,252,076 | A | 10/1993 | Kelleher | |
| 5,299,781 | A | 4/1994 | Barrett et al. | |

(Continued)

FOREIGN PATENT DOCUMENTS

DE 31 17 044 A1 11/1982

(Continued)

OTHER PUBLICATIONS

International Search Report and Written Opinion, PCT/US06/04145 (Jul. 25, 2008).

*Primary Examiner*—Victor MacArthur
(74) *Attorney, Agent, or Firm*—H. Frederick Rusche; Husch Blackwell Sanders LLP

(57) ABSTRACT

A portable, fold-over post for use on both outdoor and indoor surfaces includes a vertical member; a first spring removably connected to the vertical member, said spring having a mounting spike integrally formed therewith for insertion into a soft, outdoor surface, and said spring allowing the post to fold over upon impact; and a foot assembly interchangeable with said spring and suitable for supporting said post on a hard surface.

7 Claims, 10 Drawing Sheets

U.S. PATENT DOCUMENTS

| | | | | |
|---|---|---|---|---|
| 5,402,988 | A | 4/1995 | Eisele | |
| 5,542,679 | A | 8/1996 | Caso | |
| 5,553,863 | A | 9/1996 | Wynne | |
| 6,343,778 | B1 | 2/2002 | Brown | |
| 6,851,661 | B1 | 2/2005 | Penning | |
| 7,032,811 | B1 * | 4/2006 | Paulic et al. | 232/39 |
| 2002/0070378 | A1 | 6/2002 | Brown | |
| 2003/0111781 | A1 * | 6/2003 | Imaizumi | 267/166 |

FOREIGN PATENT DOCUMENTS

| | | | |
|---|---|---|---|
| JP | 08332823 | A * | 12/1996 |

* cited by examiner

MULTI-PURPOSE PORTABLE LAY-DOWN POST AND FENCING SYSTEM

CROSS REFERENCES

This application is a continuation-in-part of co-pending U.S. application Ser. No. 10/629,980 filed Jul. 30, 2003.

TECHNICAL FIELD OF THE INVENTION

This invention generally relates to fencing products support posts and, more particularly, to a multi-purpose, portable fence incorporating a lay-down or fold-over feature, including a fold-over post for use alone or incorporated into a panel-based fencing system.

DESCRIPTION OF THE RELATED ART

A number of outdoor and sport-related activities utilize fencing to enhance the playing environment for the activity in question. Baseball and softball are prime examples of such an activity. The construction of fencing to delineate the boundaries of the outfield and the playing field provides a more polished appearance to the field, provides the opportunity for players to hit "real" home runs, and helps limit the amount of playable foul territory surrounding the field. Fencing can also allow larger general purpose fields to be divided into several separate fields to accommodate a number of different games at one time, for example, during tournament play.

Permanent fencing, while durable and attractive, has a number of shortcomings. First of all, it can be prohibitively expensive. Also, permanent fencing does not allow for adjustments in field dimensions or field arrangements. In addition, because permanent fencing creates a solid vertical surface adjacent to the field, it presents a potential safety issue to athletes who may run into the fence while playing.

Temporary or portable fencing for athletic fields is also known in the art. Temporary fencing allows for an infinite number of adjustments in how an athletic or general purpose field can be arranged and divided for a number of different athletic events and other activities. For example, it is quite common for high schools, grade schools, or youth athletic associations to utilize a single field for football or soccer in the fall and baseball throughout the spring and summer. Temporary fencing allows these groups to arrange their limited field space in a more efficient and professional looking manner. In addition, these organizations frequently host different sporting events that involve different age groups. Temporary fencing allows an organization to customize a field's dimensions for a particular age group. For instance, a baseball outfield could be set up with smaller dimensions for grade school children than one for high school or college age athletes, allowing each of these different age groups to play on a baseball field properly suited to their size and playing ability while using the same general purpose field.

The most common form of such temporary fencing utilizes stakes to support a continuous plastic mesh material. The fences are not sturdy and tend to fall over quite easily when struck by a player or ball, requiring that the game be stopped while the fence is repositioned. Further, the stakes are generally inserted rigidly into the ground and may not give way when a player runs into them, creating a safety hazard. In addition, these fences are generally unattractive and are very labor intensive to install. Alternative designs incorporate individual fence panels made of polyvinyl chlorate ("PVC") or similar material with posts that are rigidly inserted into the ground or connected to wide feet resting perpendicular to the fence panel. Because these designs are rigidly mounted, they present the same safety concerns as permanent fencing. Furthermore, these designs have been priced out of reach of many schools, parks and recreation leagues in the past, which are the very groups that are most in need of the benefits of such fences.

Therefore, providing a fencing system capable of being installed quickly and manufactured and sold inexpensively, which does not present a significant safety hazard to athletes, would be highly desirable. Furthermore, providing a support post for fences, signs or similar items capable of folding over would also be desirable.

The present invention is directed to overcoming one or more of the problems set forth above.

SUMMARY OF THE INVENTION

An aspect of the present invention is to provide an affordable, portable fencing system for athletic fields, crowd control, and general purpose use that is quickly and easily installed.

Another aspect of the present invention is to provide a portable fencing system that is adapted for use on either outdoor turf or on indoor or hard surfaces.

Yet another aspect of the present invention is to provide a portable fencing system for athletic fields, crowd control, and general purpose use that is capable of folding over upon impact to minimize the chances for injury to a participant running into the fence and readily returning to an upright position after impact.

Another aspect of the present invention is to provide a fold-over post for use in a portable fencing system or as a general support post.

In accordance with the above aspect of the invention, there is provided a portable, fold-over post for use on both outdoor and indoor surfaces that includes a vertical member; a first spring removably connected to the vertical member, said spring having a mounting spike integrally formed therewith for insertion into a soft, outdoor surface, and said spring allowing the post to fold over upon impact; and a foot assembly interchangeable with said spring and suitable for supporting said post on a hard surface.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
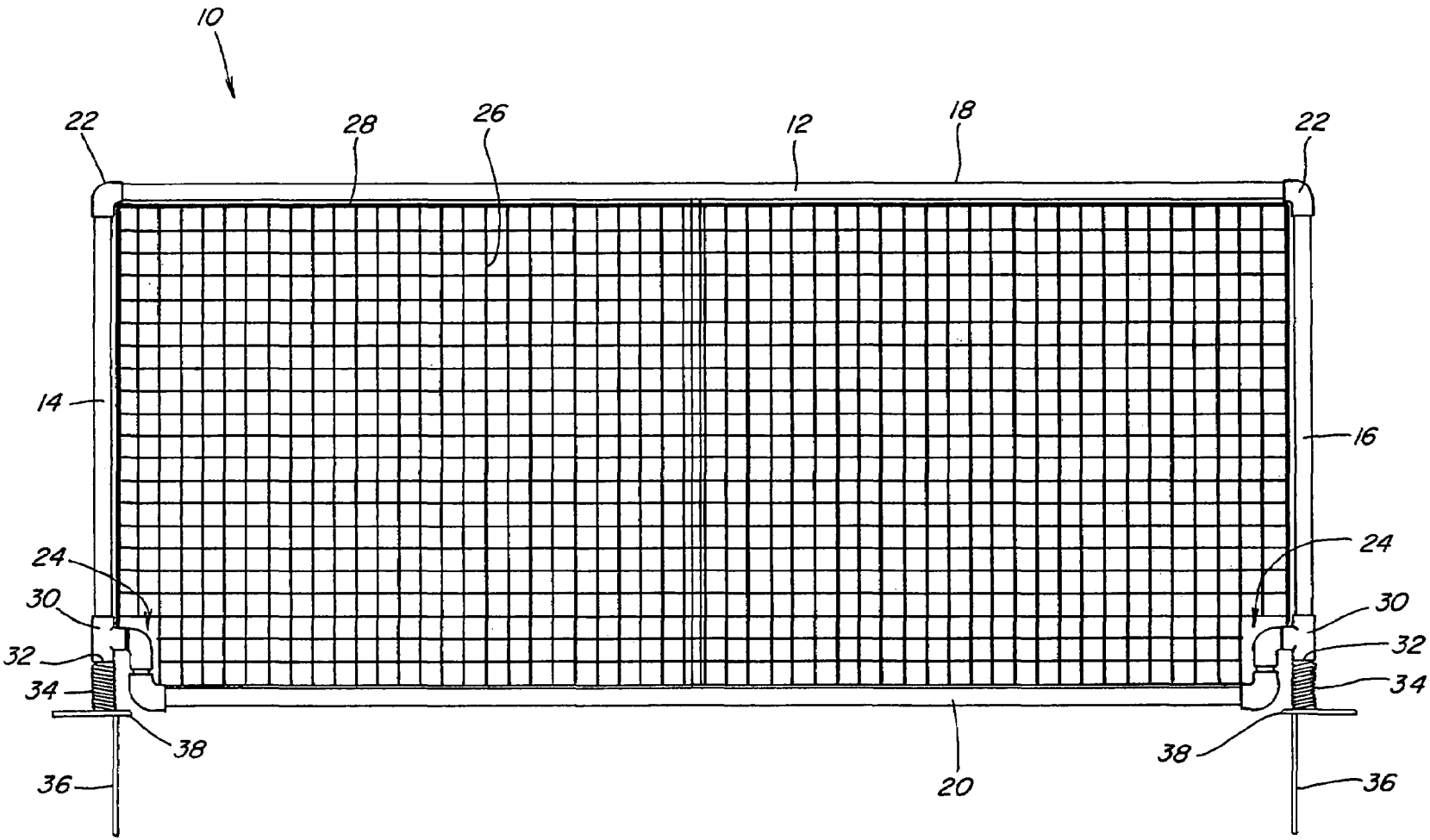
FIG. 1 is an elevation view of a portable, fold-over fence panel according to one embodiment of the present invention.
Figure 2A:
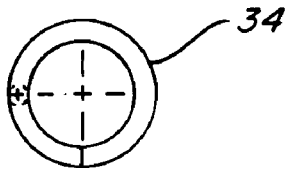
FIG. 2A is a top view of the spring/mounting spike of FIG. 2.
Figure 2:
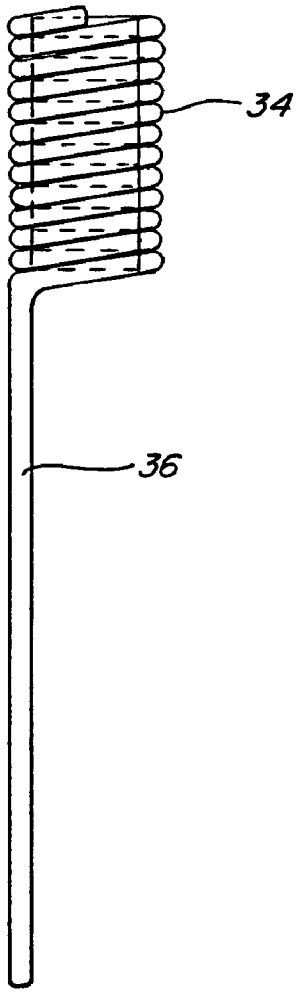
FIG. 2 is an elevation view of a combination spring/mounting spike utilized in the fence panel of FIG. 1.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1-6 illustrate a portable, multi-purpose, fold-over fence panel 10. The fence panel 10 is well-suited for use in a fencing system for delineating athletic fields, such as baseball and softball outfields, dividing a larger field into several separate athletic fields, and for general crowd control or other general purpose uses. The fence panel 10 is formed by a frame 12 that is composed of two vertical members 14, 16 and two horizontal members 18, 20. In a preferred embodiment, the vertical 14, 16 and horizontal 18, 20 members are connected by four rounded corner pieces 22. The rounded corner pieces 22 help minimize the presence of sharp corners or protrusions in the frame 12, thereby enhancing the overall safety of the fence panel 12. Advantageously, the frame 10, vertical members 14, 16, horizontal members 18, 20, and corner pieces 22 are all constructed of a tubular, lightweight, plastic material of any suitable cross-section, including round, square, rectangular, etc. In alternative embodiments, these items are constructed from wood, composite, or metal or aluminum piping. In a particularly preferred embodiment, the components of the frame 10 are composed of tubular PVC. The frame may also be constructed as a unitary structure without connecting corner pieces, e.g., a welded aluminum frame or a single aluminum pipe bent to the proper shape.

The lower horizontal member 18 of the frame 10 may be modified to include a pair of steps 24. The steps 24 aid in the installation of the fence panel by providing additional leverage for an installer in driving the mounting spikes (discussed in detail below) into the ground.

The frame 12 supports a panel of flexible material 26, which completes the fence panel 10. The panel 26 may be constructed from a number of suitable materials including a wire or plastic mesh, plastic or fabric netting, a solid panel of plastic material, or any other suitable lightweight, flexible material. In a preferred embodiment, the panel 26 is made of a flat laminar mesh made of high density polyethylene. The panel 26 is attached to the frame 12 by an attachment means 28. Suitable attachment means 28 include hook and loop fastening fabric, e.g., Velcro® strips, wire ties, or pipe. Lower profile attachment means without protrusions are preferred in order to enhance the safety of the fence panels.

The panel 26 can be personalized in a number of different ways. A particular color of material may be selected for the panel 26 to match a school's or an organization's unique color scheme. The panel 26 may also be adapted to hold a message banner, for example, advertisements of corporate event sponsors, thereby providing an additional source of revenue for an event organizer.

The two lower corner pieces 22 are advantageously T-shaped connectors 30. The lower ends of these connectors provide the means for attaching a pair of springs 30 to the frame 12. An adapter 32 is inserted into the lower end of each T-shaped connector 30. A spring 34 is then slipped onto the adapter 32. The spring 34 is a coil spring preferably constructed of ⅜" diameter wire and is formed with an inside diameter slightly smaller than the outside diameter of the adapter 32 in order to create an interference fit between the spring 34 and the adapter 32. Each spring 34 terminates in a mounting spike 36.

In order to install the fence panel 10, the two mounting spikes 36 are inserted into the ground to provide a foundation for the fence panel 10. In a preferred embodiment, each mounting spike 36 is inserted through a plate 38 to provide additional stability to the fence panel 10. Each plate 38 is provided with a hole 40 having an inside diameter roughly equal or slightly larger than the wire gauge of the spring/mounting spike. The plate 38 rests at the top of the mounting spike 36 adjacent to the spring 34. Once installed, the plate 38 is sandwiched between the ground surface and the spring 34. The plate 38 is particularly beneficial when the fence panel 10 is installed on wet, muddy or loose turf. In a preferred embodiment, the plate 38 is also provided with a depression 41 that conforms to the angled bottom of the spring 34. This arrangement helps support the spring 34 in a more upright position, thereby further enhancing the stability and appearance of the fence panel 10.

The arrangement of the springs 34, mounting spikes 36 and stability plates 38 provide a particularly fast and efficient method of installing temporary fencing. Using this arrangement an entire baseball outfield fence utilizing approximately 150 feet or more of fence panels may be installed by two individuals in less than one hour. This arrangement also speeds removal of the fence panels.

Once the fence panel 10 is installed, the springs 34 act as a pivot point for the entire fence panel 10. If a player strikes the fence, for example, when chasing down a fly ball during a baseball or softball game, the springs 34 allow the fence panel 10 to fold flat during impact, thereby reducing the force of the impact on the player and limiting the potential for injury to the player. Advantageously, the coil spring design allows the springs 34 to respond to an impact occurring from almost any angle, including perpendicular to the fence panel or at a very shallow angle, i.e., when a player is running almost parallel to the fence prior to impact. The fence panel 10 will also fold over from an impact initiated from either side of the fence. This feature allows the fence to be used in configurations where play occurs simultaneously on both sides of the fence, for example, where a single fence separates the outfield of one baseball field from the outfield of another field, while producing the same safety advantages to players on both of the fields.

After impact and once the player has recovered and removed his/her weight from the fence panel 10, the panel readily returns to its upright position and is ready for further play without the need for repositioning or additional maintenance. This rebound feature is created by the use of a wire gauge in the design of the spring 34 that is capable of producing a spring force sufficient to counterbalance the weight of the frame 12. The rebound feature eliminates any delay to the game due to an impact between a player and the fence.

Figure 3:
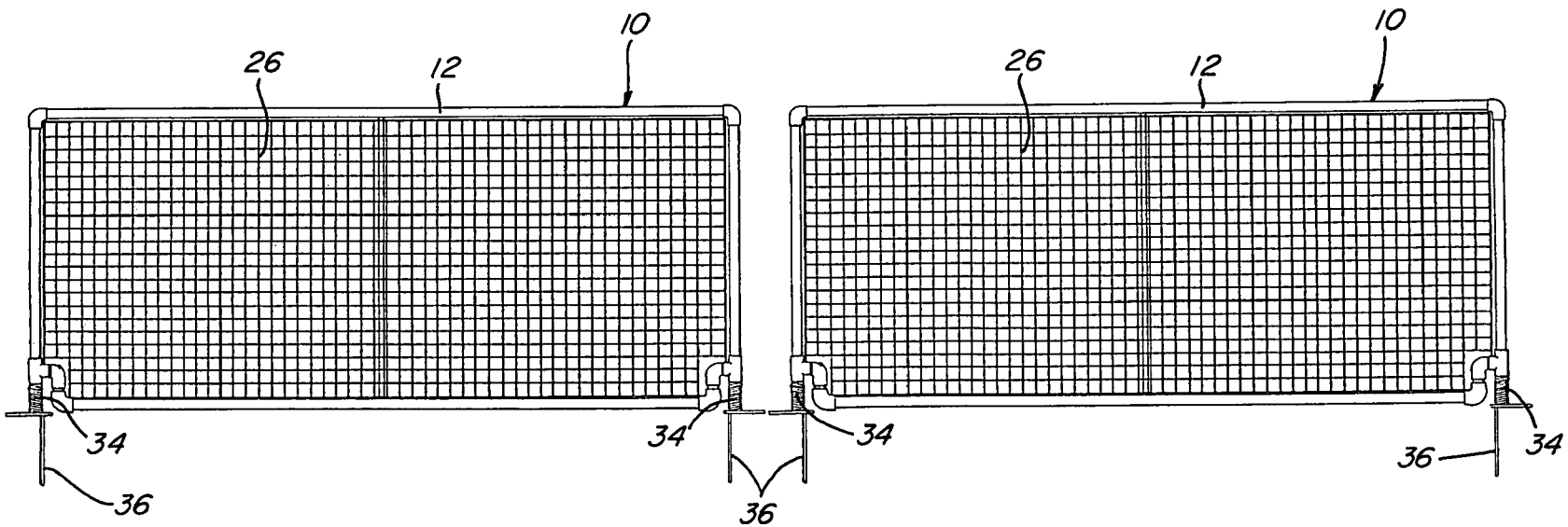
FIG. 3 is an elevation view of a portable, fold-over fence composed of separate panels according to another embodiment.
Figure 4:
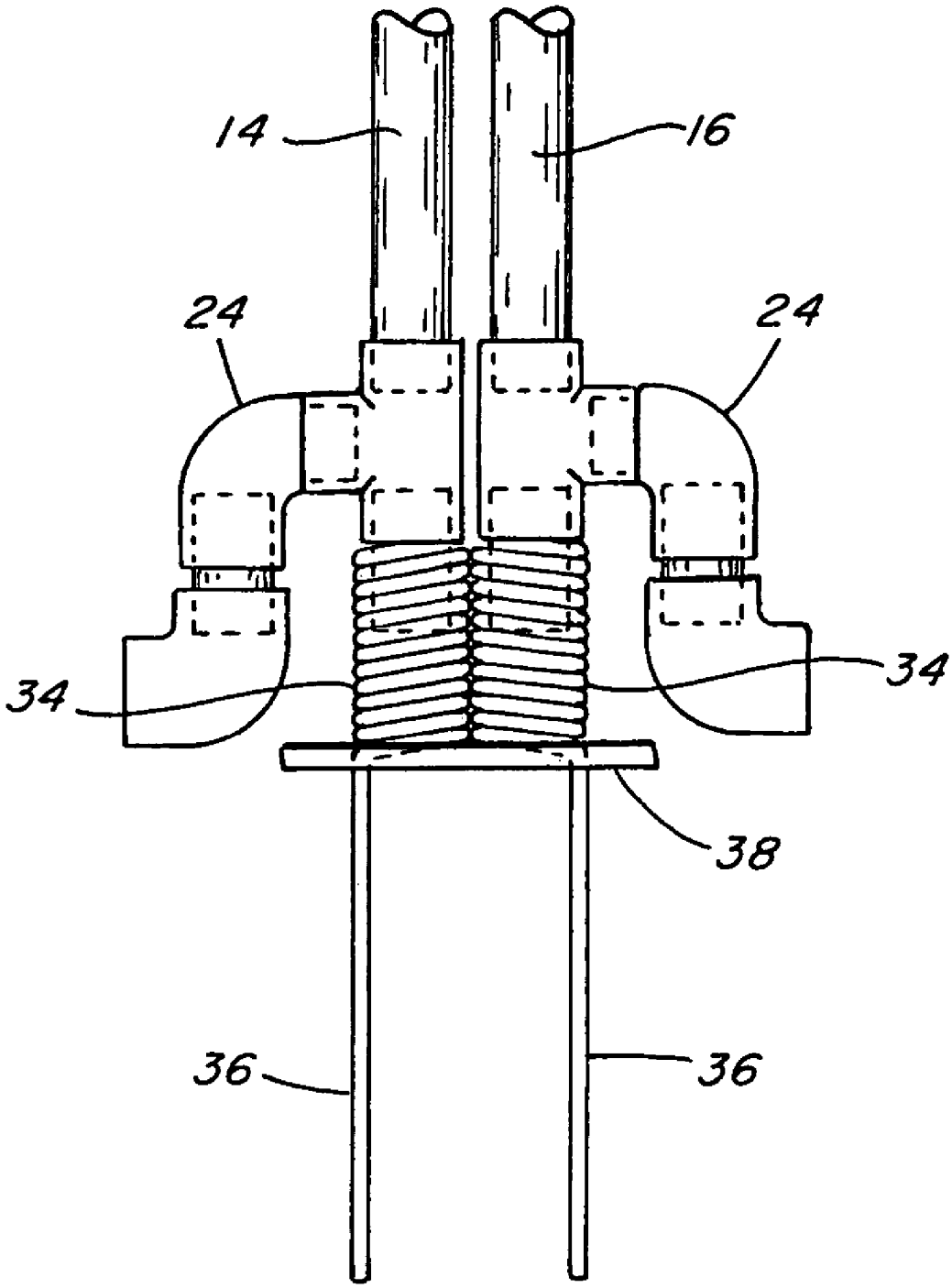
FIG. 4 is an elevation view of an interconnected spring/mounting spike assembly for a portable, fold-over fence composed of separate panels.
Figure 5:
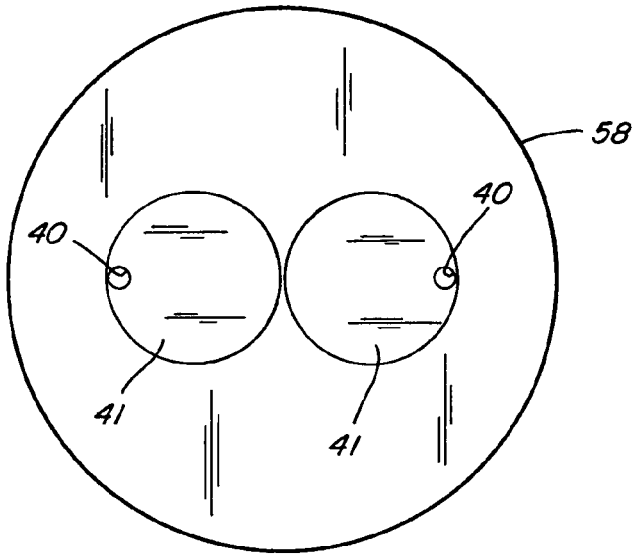
FIG. 5 is a plan view of a stability plate suitable for use with the embodiment of FIG. 4.
Figure 5A:
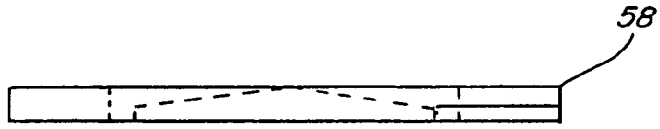
FIG. 5A is a side view of the stability plate of FIG. 5.
Figure 6:
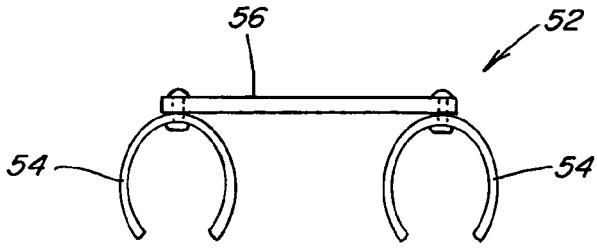
FIG. 6 is a plan view of a connecting clip suitable for interconnecting portable, fold-over fence panels according to another embodiment.

As shown in FIG. 3, a fence composed of fence panels 10 as described herein is constructed by installing a plurality of fence panels 10 immediately adjacent one another in a desired pattern, e.g., the outline of a baseball or softball outfield or to separate adjacent athletic fields. In installing the fence panels 10, it is not necessary that the fence panels be interconnected. The fence panels do not require interconnection for stability. Leaving the fence panels unconnected allows each individual fence panel to fold over and rebound on its own without affecting the neighboring panels. However, the panels may be interconnected if necessary with hook and loop fastening fabric, e.g., Velcro® strips, or other releasable means, thereby allowing individual panels to "break away" from adjacent panels upon impact. One alternate means of interconnecting adjacent fence panels, shown in FIG. 6, includes a connecting clip 52 formed by two open circular clips 54 preferable constructed of a lightweight plastic that are connected by a band 56. The open sides of the clips 54 allow the connecting clip 52 to "release" from one or both of the adjacent fence panels upon impact. An alternate means of interconnecting adjacent fence panels utilizes a dual stability plate 58. The plate 58 includes two holes 40 to accommodate mounting spikes 36 and two conforming depressions 41 to accommodate springs 34. In a particularly preferred version of this embodiment, the springs 34 for the adjacent fence panels 10 are connected together prior to installation on the adjacent fence panels and insertion into the stability plate 58.

Figure 7:
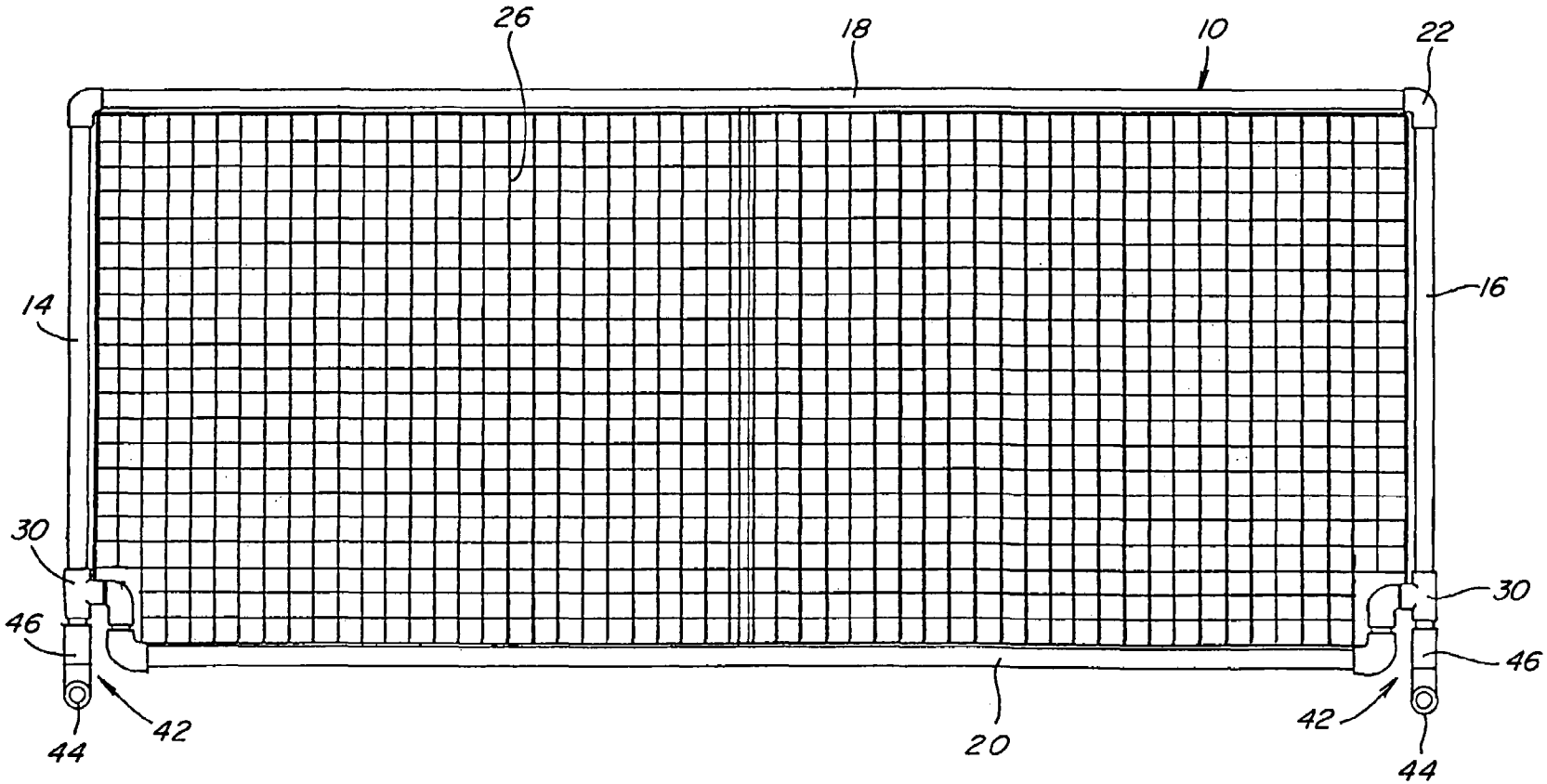
FIG. 7 is an elevation view of a multi-purpose, portable fence panel according to another embodiment.
Figure 7A:
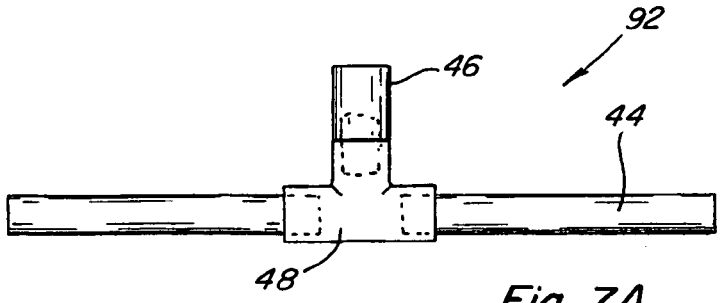
FIG. 7A is a side view of a foot assembly suitable for use with the embodiment of FIG. 7.

FIG. 7 illustrates the convertible nature of the above described fencing system. Each fence panel 10 may be quickly and easily adapted for use on any hard outdoor or indoor surface by replacing the adapters 32 and springs 34 with a pair of foot assemblies 42. Each foot assembly 42 includes a horizontal foot 44, a vertical leg 46, which is inserted into the lower end of T-shaped connector 30, and a T-connector 48, which connects the horizontal foot 44 and the vertical leg 46. In a preferred embodiment, the components of the foot assemblies 42 are constructed of tubular PVC. In an alternate embodiment, a spring 50 having a similar construction to spring 34, but without the mounting spike 36, is slipped onto the vertical leg 46 and the adapter 32. This embodiment allows the fence panel 10 to retain its fold-over and rebound features while using the foot assemblies 42. The ability to convert the fence panels 10 from outdoor to indoor use allows organizations to utilize the fencing system for a larger number of events, thereby enhancing the utility, value, and affordability of the fencing system.

Figure 8:
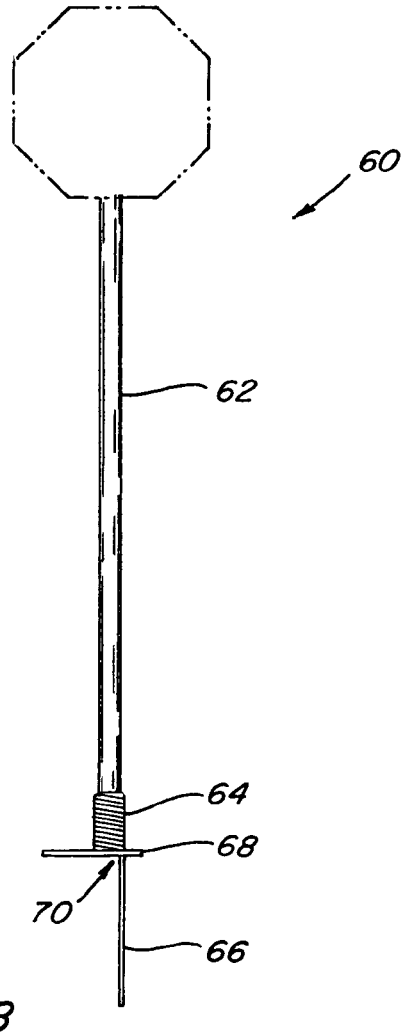
FIG. 8 is an elevation view of a fold-over post according to another embodiment of the present invention.

FIG. 8 illustrates a fold-over post 60 according to another embodiment. The post 60 includes a vertical member 62. The vertical member may be constructed from any suitable rigid or semi-rigid material, including, as non-limiting examples, PVC pipe, metal pipe, wood, composite, or plastic. While vertical member 62 in the embodiment shown in FIG. 8 is provided with a tubular cross-section, any cross-sectional shape may be used. The lower end of the vertical member 62 is inserted into a spring 64. The spring 64 is of substantially similar construction to the spring 34 used in the fence panel described previously. The spring 64 is a coil spring preferably constructed of ⅜" diameter wire and is formed with an inside diameter slightly smaller than the outside diameter of the vertical member 62 in order to create an interference fit between the spring 64 and the vertical member 62. The spring 64 terminates in a mounting spike 66.

In a preferred embodiment, the mounting spike 66 is inserted through a plate 68 to provide additional stability to the vertical member 62. The plate 68 is substantially similar to plate 38 but including only a single hole having an inside diameter roughly equal or slightly larger than the wire gauge of the spring/mounting spike and a single depression that conforms to the angled bottom of the spring 64. The plate 68 rests at the top of the mounting spike 66 adjacent to the spring 64. Once installed, the plate 68 is sandwiched between the ground surface and the spring 64. This arrangement helps support the spring 64 in a more upright position, thereby further enhancing the stability and appearance of the vertical member 62.

As with the springs 34 in the fence panel 10, the springs 64 on the vertical member 62 acts as a pivot point for the vertical member 62. If a player or vehicle strikes the post 60, the spring 64 allows the post 60 to fold over during impact from any angle.

Figure 9:
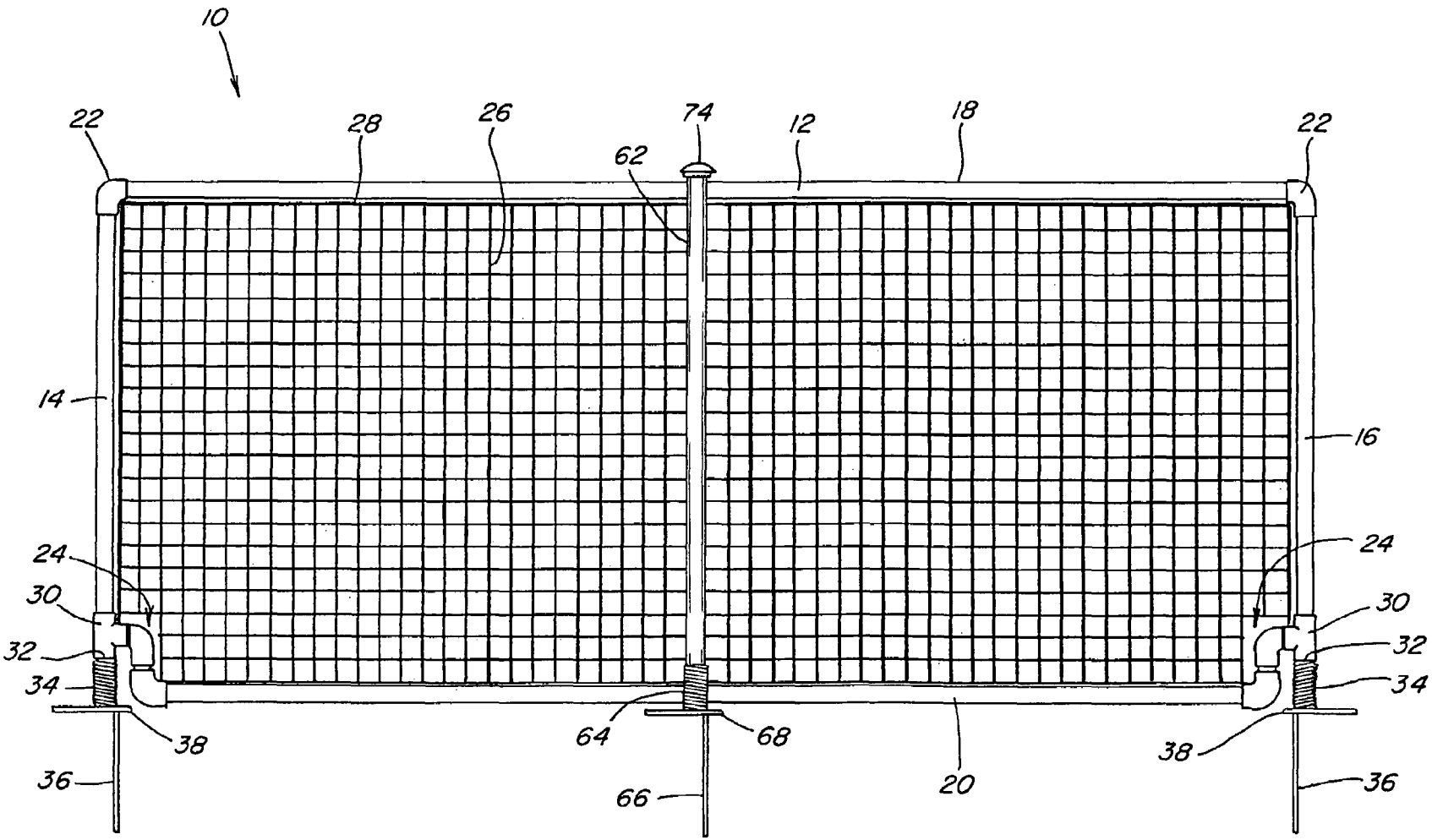
FIG. 9 is an elevation view of a fence panel incorporating an embodiment of a fold-over post.

The fold-over post 60 may utilized with the fence panel 10, as illustrated in FIG. 9, to provide additional support for the panel 10 in extreme wind conditions or where it is desired to use a heavier panel 26 that may be more resistant to wind. In this application, the fold-over post 60 is installed immediately adjacent to the downwind side of the fence panel 10 at approximately the midpoint of the fence panel 10.

Figure 10:
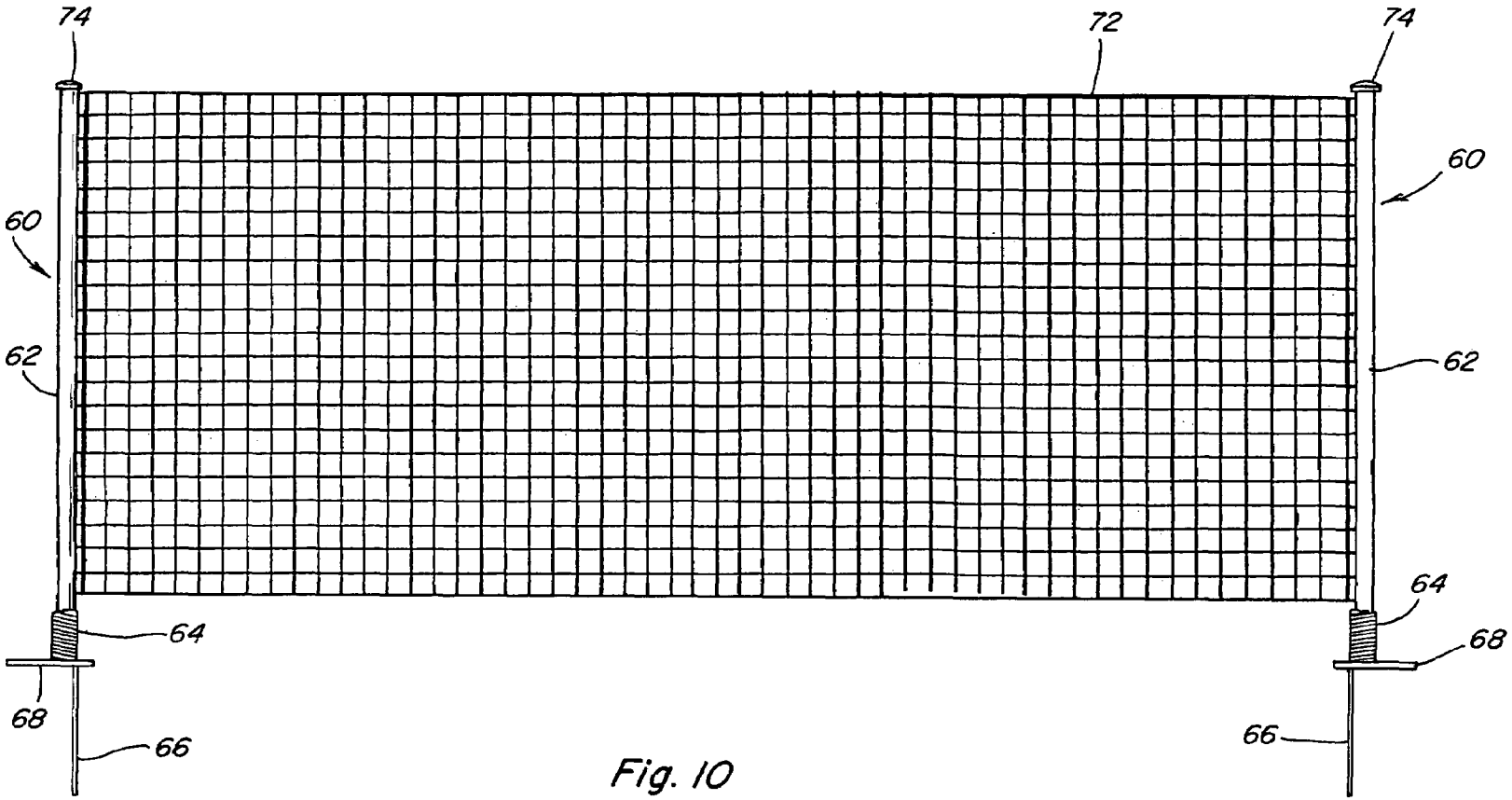
FIG. 10 is an elevation view of a fencing system incorporating an embodiment of a fold-over post.

In another application that is illustrated in FIG. 10, multiple posts 60 are used in combination with flexible fencing material 72 to form a fence. This application results in a fold-over fencing system that is extremely easy to install in a short period of time. The flexible fencing material 72 may be constructed from wire or plastic mesh, plastic or fabric netting, solid plastic or canvas material, or any other suitable lightweight, flexible material. In a preferred embodiment, the flexible material 72 is provided in a continuous length of material that is unwound and connected to each fold-over post 60 by any suitable method. In another preferred embodiment, the post is provided with a cap 74, that may advantageously be constructed of a cushioned material, such as a foam or a lower density plastic. The cap 74 provides additional protection for players that may impact the top of the post 60.

Figure 11:
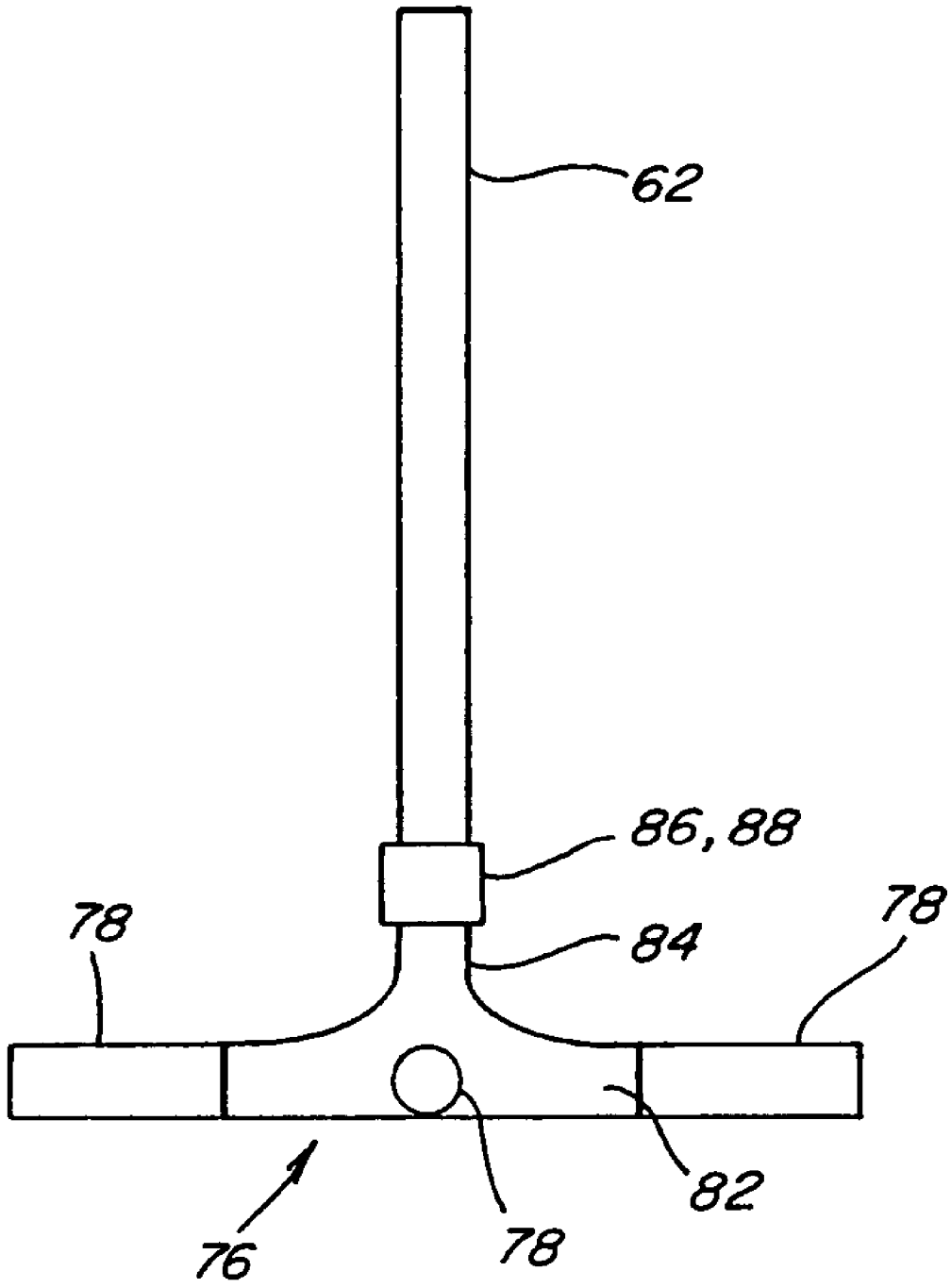
FIG. 11 is a side view of a foot assembly suitable for use with a fold-over post.

Like the fence panel 10 described above, the fold-over post 60 is adaptable for use on indoor or other hard surfaces. FIG. 11 illustrates the convertible nature of the post 60. Spring 64 may be removed and replaced with a foot assembly 76. Each foot assembly 76 includes cross members 78 that are connected with one another by a connecting member 82. The connecting member 82 includes a vertical portion 84. The vertical member 62 of the post 60 is inserted into one end of an adapter 86, while the vertical portion 84 of the connecting member 82 is inserted into the other end of the adapter 86 to complete the conversion. In a preferred embodiment, the components of the foot assembly 76 are constructed of tubular PVC. In an alternate embodiment, a spring 88 having a similar construction to spring 64, but without the mounting spike 66, replaces the adapter 86 and is slipped onto the vertical member 62 and the vertical portion 84 of the connecting member 82. This embodiment allows the post 60 to retain its fold-over and rebound features while using the foot assembly 76.

Other objects, features and advantages of the present invention will be apparent to those skilled in the art. While preferred embodiments of the present invention have been illustrated and described, this has been by way of illustration and the invention should not be limited.

What is claimed is:

1. A portable, fold-over post, comprising:

a vertical member configured for a fence post;

a first coil spring removably connected to the vertical member, said first spring having a mounting spike integrally formed therewith and operable for insertion into a soft, outdoor surface, and said spring allowing the post to fold over upon impact, a stability plate having first and second sides, said first side defining a depression having a bottom surface aligned at an angle relative to a plane of said stability plate and conforming generally to a bottom coil of said first coil spring, said second side being flat such that it rests flush and level with said surface, said stability plate further defining a cylindrical passage generally transverse to said plane of said stability plate and in communication with said depression; and wherein said mounting spike is inserted through said cylindrical passage and into said surface, said bottom coil of said first spring rests within said depression, and said stability plate lies horizontally between said surface and said first spring.

2. The portable, fold-over post as set forth in claim 1, further comprising a cap connected to said vertical member.

3. The portable, fold-over post as set forth in claim 1, wherein said spring is a coil spring and is constructed of ⅜" diameter wire.

4. A fold-over, portable fencing system, comprising:

a plurality of fold-over posts arranged in a desired pattern, each post comprising:

a vertical member; and a first coil spring removably connected to said vertical member, said first spring having a mounting spike integrally formed therewith and operable for insertion into a soft, outdoor surface, and said first spring allowing the post to fold over upon impact;

a stability plate having first and second sides, said first side defining a depression having a bottom surface aligned at an angle relative to a plane of said stability plate and conforming generally to a bottom coil of said first coil spring, said second side being flat such that it rests flush and level with said surface, said stability plate further defining a cylindrical passage generally transverse to said plane of said stability plate and in communication with said depression, wherein said mounting spike is inserted through said cylindrical passage and into said surface, said bottom coil of said first spring rests within said depression, and said stability plate lies horizontally between said surface and said first spring; and a length of flexible fencing material connected to each of said fold-over posts.

5. The fold-over, portable fencing system as set forth in claim 4, wherein the flexible fencing material is a flat laminar mesh made of high density polyethylene.

6. The fold-over, portable fencing system as set forth in claim 4, wherein said flexible fencing material is connected with said post by hook and loop fastening fabric.

7. The fold-over, portable fencing system as set forth in claim 4, wherein said first spring is coil springs and is constructed of ⅜" diameter wire.

* * * * *